US010822220B1

(12) United States Patent
Lin

(10) Patent No.: US 10,822,220 B1
(45) Date of Patent: Nov. 3, 2020

(54) CONTAINER FAUCET ASSEMBLY

(71) Applicant: Yen-Lin Lin, Tainan (TW)

(72) Inventor: Yen-Lin Lin, Tainan (TW)

( * ) Notice: Subject to any disclaimer, the term of this patent is extended or adjusted under 35 U.S.C. 154(b) by 0 days.

(21) Appl. No.: 16/744,260

(22) Filed: Jan. 16, 2020

(51) Int. Cl.
*B67D 3/00* (2006.01)
*B67D 3/04* (2006.01)

(52) U.S. Cl.
CPC ..... *B67D 3/045* (2013.01)

(58) Field of Classification Search
CPC ..... B67D 3/04; B67D 3/043; B67D 3/045; B67D 3/047
See application file for complete search history.

(56) References Cited

U.S. PATENT DOCUMENTS 1,495,403 A * 5/1924 Davis ..... B67D 3/045 137/385
3,100,586 A * 8/1963 Haynes ..... B67B 7/26 222/90
3,239,104 A * 3/1966 Scholle ..... B67B 7/26 222/81
4,948,877 A * 8/1990 Mitra ..... C07K 16/065 424/176.1
4,997,108 A * 3/1991 Hata ..... B65D 77/067 137/614.13
10,717,579 B2 * 7/2020 Johnson ..... B67D 3/045

* cited by examiner

*Primary Examiner* — J C Jacyna
(74) *Attorney, Agent, or Firm* — Karin L. Williams; Mayer & Williams PC

(57) ABSTRACT

A container faucet assembly includes a locking device disposed on a container and having a locking knob. A tubular member has a through-hole, an insertion section, a coupling section, and a front section. The insertion section is coupled with the container. The coupling section includes an outer periphery having at least one guiding groove with a transverse section. A seal is disposed around the front section. The faucet further includes a coupling portion having a coupling hole intercommunicating with an outlet of the faucet. An inner periphery of the coupling hole includes at least one protrusion slidably received in the at least one guiding groove. A radial hole extends through the inner periphery of the coupling hole and intercommunicates with the coupling hole. A locking end of the locking knob extends into the radial hole. A sealing portion is disposed on the inner periphery of the coupling hole.

9 Claims, 9 Drawing Sheets

A - A

B - B

CONTAINER FAUCET ASSEMBLY

BACKGROUND OF THE INVENTION

The present invention relates to a container faucet assembly and, more particularly, to a container faucet assembly with improved assembling convenience and a stable structure.

A type of container includes a faucet at a lower end thereof to permit dispensing of a liquid in the container without moving the container. The liquid in the container can be a beverage, such as tea, coffee, fruit juice, etc. The faucet can be detached from the container to allow easy cleaning and easy sanitary maintenance.

FIGS. 8 and 9 show a conventional faucet assembly for a container 1'. The faucet assembly includes a faucet 3' and a connecting device 2' disposed on the container 1'. The connecting device 2' includes a tube 21' and a knob 22'. The tube 21' includes a rear end coupled to an outlet 11' of the container 1' and a front end with a first conical face 211'. The tube 21' further includes an abutting portion 212' on an outer periphery thereof. The knob 22' is disposed on the tube 21' and includes an intermediate portion having a threaded portion 221' at a central portion thereof. An abutting edge 222' is disposed on a rear end of the threaded portion 221' and abuts the abutting portion 212' of the tube 21'. The faucet 3' includes a coupling portion 31' on a side thereof and having a coupling hole 311' coupled with the front end of the tube 21'. The coupling hole 311' includes a second conical face 312' abutting the first conical face 211'. A threaded portion 313' is disposed on an outer periphery of the coupling portion 31' and is in threading connection with the threaded portion 221' of the knob 22'.

In assembly, the coupling hole 311' of the coupling portion 31' is coupled with the front end of the tube 21'. The knob 22' is rotated to threadedly engage the threaded portion 221' with the threaded portion 313'. The abutting edge 222' abuts against the abutting portion 212' to tightly press the first conical face 211' against the second conical face 312', providing a better sealing effect for preventing leakage.

In the above structure, a force must be applied to rotate the knob 22' to a tightened state tightly abutting the first conical face 211' against the second conical face 312' so as to reliably prevent leakage of the liquid in the container 1'. However, when cleaning the faucet 3' is desired, it is difficult to apply a force in the reverse direction for detaching the knob 2' from the faucet 3'. Furthermore, when the coupling hole 311' is not aligned with a center of the front end of the tube 21' during assembly, the first and second conical faces 211' and 312' cannot reliably abut against each other and could deform, leading to unsatisfactory assembling stability and leakage of the liquid.

BRIEF SUMMARY OF THE INVENTION

An objective of the present invention is to provide a faucet assembly with improved assembling convenience and a stable structure.

A container faucet assembly according to the present invention includes a container having a compartment and an engaging portion. A locking device is disposed on the engaging portion. The locking device includes a locking knob having a locking end. A connecting device includes a tubular member having a through-hole extending from a front end thereof through a rear end thereof. The tubular member includes, front rear to front, an insertion section, a coupling section, and a front section. The insertion section is coupled with the engaging portion of the container. The coupling section has a rear end connected to the insertion section. The coupling section further includes an outer periphery having at least one guiding groove extending from a front end of the coupling section towards the rear end of the coupling section. The at least one guiding groove includes a transverse section extending transversely from a rear end thereof and at a non-parallel angle to an extending direction of the at least one guiding groove. The coupling section has a locking hole for coupling with the locking end of the locking knob. A seal is disposed around the front section. A faucet includes an outlet. The faucet further includes a coupling portion on a side thereof. The coupling portion includes a coupling hole intercommunicating with the outlet. The coupling hole includes a rear end having an inner diameter larger than an outer diameter of the coupling section of the tubular member. An inner periphery of the coupling hole includes at least one protrusion slidably received in the at least one guiding groove. The faucet further includes a radial hole extending through the inner periphery of the coupling hole and intercommunicating with the coupling hole. The locking end of the locking knob is configured to extend into the radial hole. A sealing portion is disposed on the inner periphery of the coupling hole. The at least one protrusion of the faucet is movable along the at least one guiding groove. The faucet is pivotable to move the at least one protrusion of the faucet into the transverse section when the at least one protrusion is aligned with the transverse section. The locking end of the locking knob is insertable into and positionable in the coupling hole of the faucet and the locking hole of the tubular member. The sealing portion of the faucet is in sealing contact with the seal.

In an example, the locking device further includes an elastic element providing operating elasticity to the locking knob.

In an example, the engaging portion of the container includes an engaging hole and a protrusion. The protrusion is disposed adjacent to a peripheral edge of the engaging hole and includes a through bore extending in a direction perpendicular to an extending direction of the engaging hole. An insertion section extends from a side of the locking knob and extends through the through bore of the protrusion of the container. A gripping end is connected to an end of the insertion section and has a diameter larger than the through bore of the protrusion. The locking end is in the form of a locking nut connected to another end of the insertion section, is aligned with the engaging hole of the container, and has a diameter larger than the through bore of the protrusion. The locking device further includes an elastic element in a form of a compression spring having two ends abutting against the protrusion of the container and the locking nut of the locking knob, biasing the locking nut towards the engaging hole.

In an example, the insertion section of the tubular member includes a rear end extending through the engaging hole of the container. The insertion section includes flange includes a front end abutting the peripheral edge of the engaging hole. The insertion section includes an outer threading. A fastening member is threadedly mounted around the insertion section and abuts against the peripheral edge of the engaging hole after the insertion section of the tubular member is inserted into the engaging hole of the container, providing a positioning effect.

In an example, a positioning groove is defined in an inner periphery of the engaging hole. The insertion section includes a key. When the key engages with the positioning groove, the locking hole is aligned with the locking nut of the locking knob.

In an example, the at least one guiding groove includes a front end and a rear end. The front end of the at least one guiding groove has a width larger than a width of the rear end of the at least one guiding groove.

In an example, the front section of the tubular member has a diameter smaller than a diameter of the coupling section. A shoulder is formed between the front section and the coupling section. An annular groove is disposed in the front section. The seal is mounted in the annular groove and has an outer diameter larger than the diameter of the front section after the seal is mounted in the annular groove.

In an example, the sealing portion of the faucet is disposed at a front end of the inner periphery of the coupling hole, has a diameter slightly larger than the diameter of the front section of the tubular member, and abuts against the seal.

In an example, the front section of the tubular member includes a front end having a conical face. The conical face has increasing diameters from a front end thereof towards a rear end thereof.

The present invention will become clearer in light of the following detailed description of illustrative embodiments of this invention described in connection with the drawings.

DETAILED DESCRIPTION OF THE INVENTION

Figure 1:
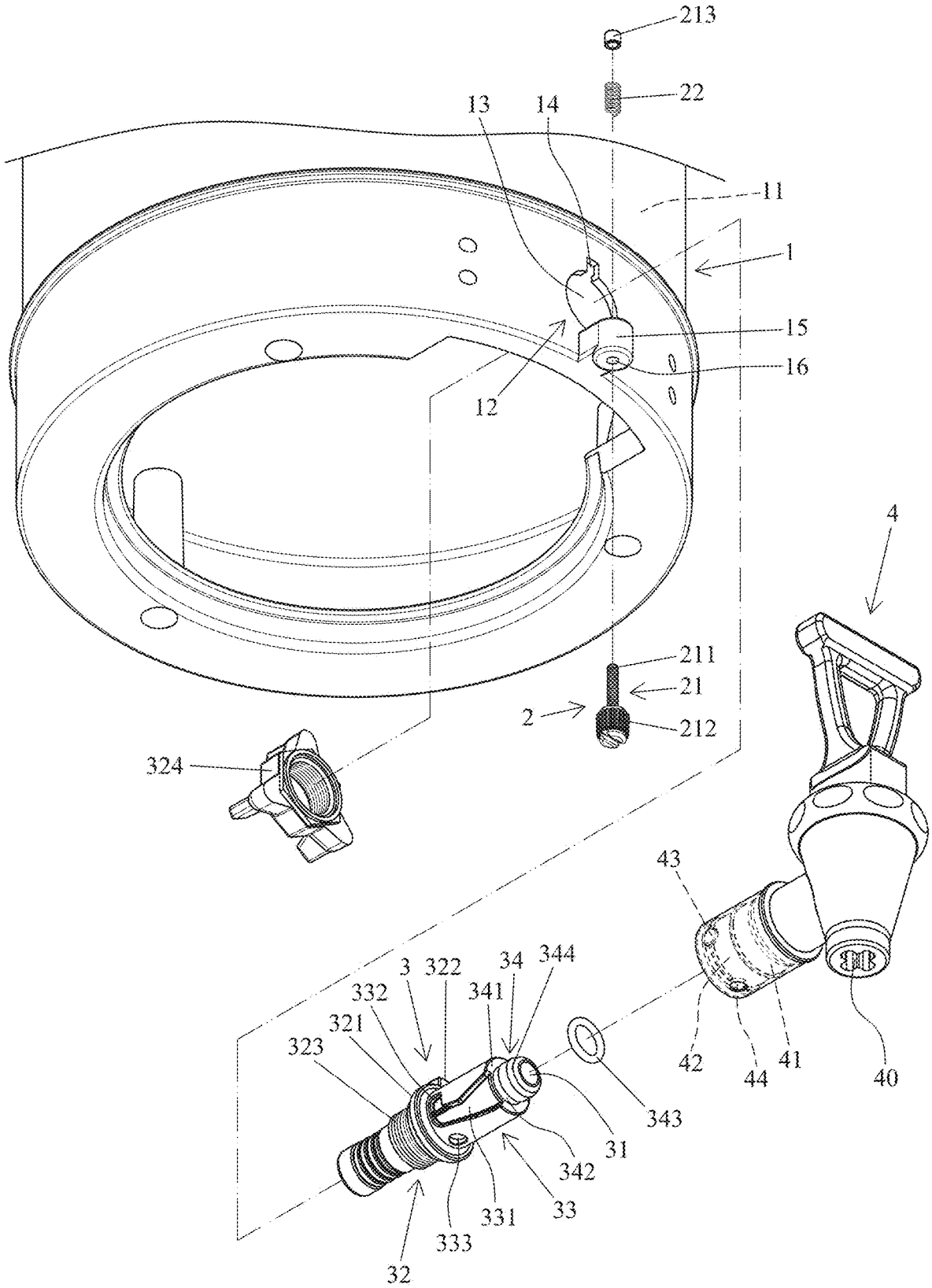
FIG. 1 is a partial, exploded, perspective view of a container faucet assembly of an embodiment according to the present invention.
Figure 2:
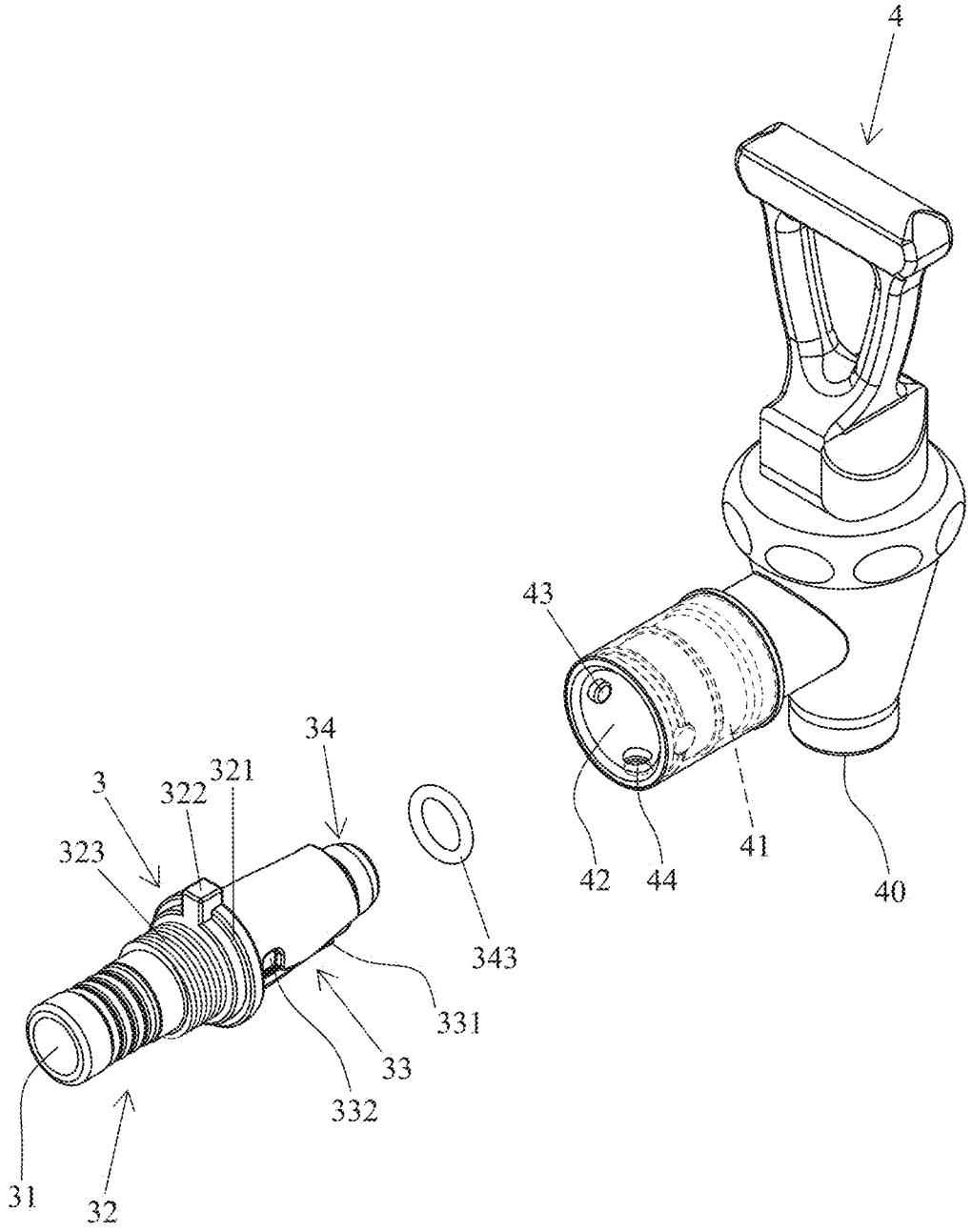
FIG. 2 is another perspective view of a portion of the container faucet assembly of FIG. 1.

With reference to FIGS. 1-7, a container faucet assembly of an embodiment according to the present invention includes a container 1, a locking device 2, a connecting device 3, and a faucet 4. In this embodiment, the direction in which the container 1 faces the faucet 4 is the front direction. The container 1 includes a compartment 11 and an engaging portion 12. The engaging portion 12 of the container 1 includes an engaging hole 13 and a protrusion 15. A positioning groove 14 is defined in an upper portion of an inner periphery of the engaging hole 13. The protrusion 15 is disposed adjacent to a peripheral edge of the engaging hole 13 and is located below the engaging hole 13 in this embodiment. A through bore 16 extends through the protrusion 15 in a direction perpendicular to an extending direction of the engaging hole 13.

The locking device 2 includes a locking knob 21 and an elastic element 22. An insertion section 211 extends from a side of the locking knob 21 and extends through the through bore 16 of the protrusion 15 of the container 1. A gripping end 212 is connected to an end of the insertion section 211 and has a diameter larger than the through bore 16 of the protrusion 15. In this embodiment, a locking end 213 in the form of a locking nut is connected to another end of the insertion section 211, is aligned with the engaging hole 13 of the container 1, and has a diameter larger than the through bore 16 of the protrusion 15. In this embodiment, the elastic element 22 is in the form of a compression spring having two ends abutting against the protrusion 15 of the container 1 and the locking end 213 of the locking knob 21, biasing the locking end 213 towards the engaging hole 13. The gripping end 212 of the locking knob 21 can be pulled to move the locking end 213 away from the engaging hole 13.

Figure 6:
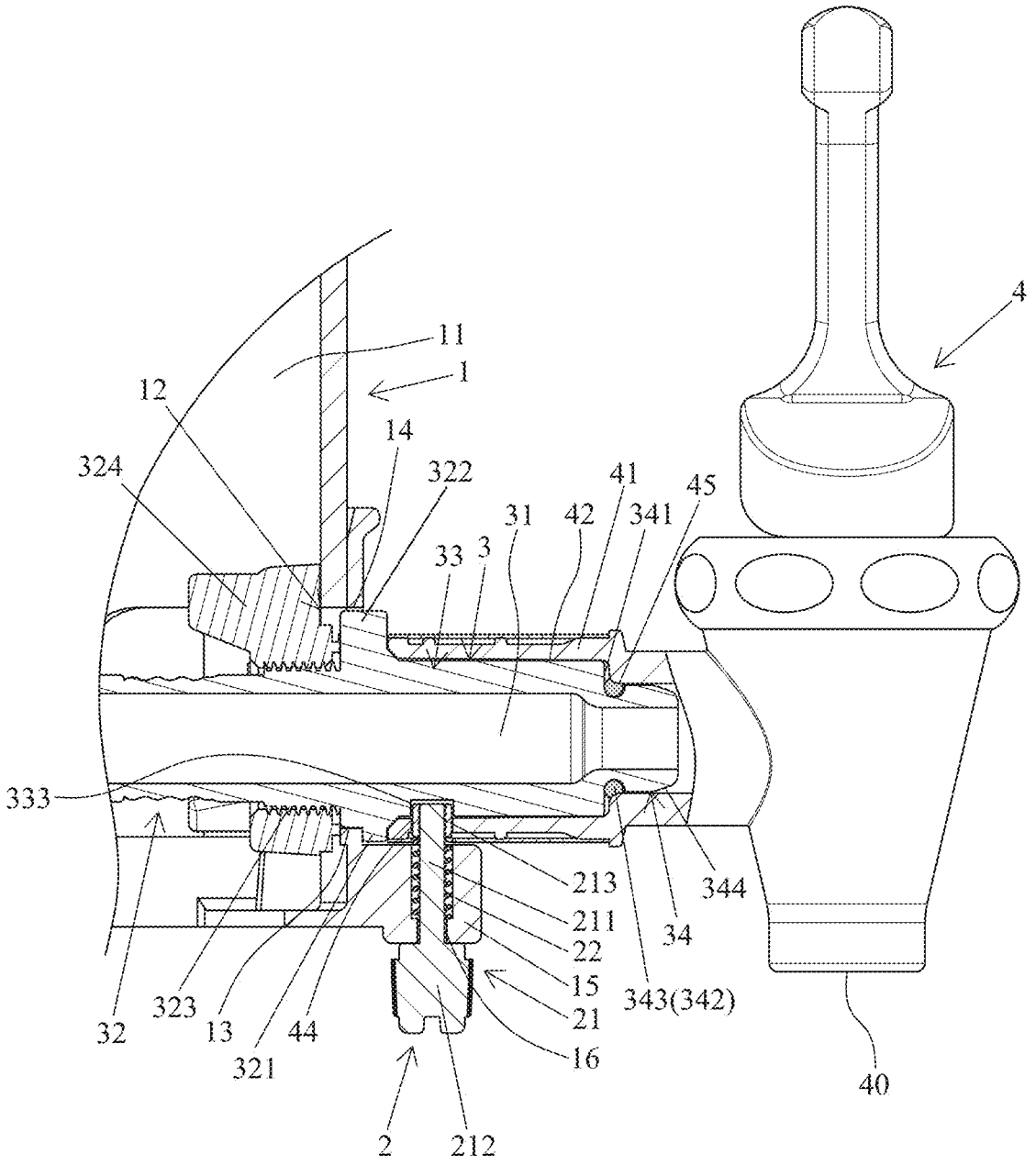
FIG. 6 is a cross sectional view taken along section line A-A of FIG. 5.

In this embodiment, the connecting device 3 includes a tubular member having a through-hole 31 extending from a front end thereof through a rear end thereof. The tubular member includes, front rear to front, an insertion section 32, a coupling section 33, and a front section 34. The insertion section 32 is coupled with the container 1 and has a rear end extending through the engaging hole 13 of the container 13. A front end of the insertion section 32 includes a flange 321 abutting the peripheral edge of the engaging hole 13. The insertion section 32 includes a key 322 on an outer periphery thereof for engaging with the positioning groove 14. The insertion section 32 includes an outer threading 323. After the insertion section 32 extends rearwards into the engaging hole 13, a fastening member 324 is threadedly mounted around the insertion section 32 and abuts against the peripheral edge of the engaging hole 13, providing a positioning effect, as shown in FIG. 6. Furthermore, the coupling section 33 and the front section 34 are located outside of the container 1. Furthermore, the insertion section 32 can be coupled with a tube (not shown) for intercommunicating with the compartment 11 of the container 1.

The coupling section 33 has a rear end connected to the insertion section 32. The coupling section 33 further includes an outer periphery having two guiding groove 331 each extending from a front end of the coupling section 33 towards the rear end of the coupling section 33. In this embodiment, the two guiding grooves 331 spaced from each other by 180°. Each guiding groove 331 includes a transverse section 332 extending transversely from a rear end thereof and at a non-parallel angle to an extending direction of the guiding groove 331. Furthermore, the coupling section 33 includes a locking hole 333 for coupling with the locking end 213 of the locking knob 21.

The front section 34 has a diameter smaller than a diameter of the coupling section 33. A shoulder 341 is formed between the front section 34 and the coupling section 33. An annular groove 342 is disposed in the front section 34. A seal 343 is mounted in the annular groove 342 and can be made of an elastic material. The seal 343 has an outer diameter larger than the diameter of the front section 34 after the seal 343 is mounted in the annular groove 342. The front section 34 includes a front end having a conical face 344. The conical face 344 has increasing diameters from a front end thereof towards a rear end thereof.

The faucet 4 includes an outlet 40. The faucet 40 further includes a coupling portion 41 on a side thereof. The coupling portion 41 includes a coupling hole 42 intercommunicating with the outlet 40. The coupling hole 42 includes a rear end having an inner diameter larger than an outer diameter of the coupling section 33 of the tubular member.

In this embodiment, an inner periphery of the coupling hole 42 includes two protrusions 43 slidably received in the two guiding grooves 331, respectively. The faucet 4 further includes a radial hole 44 extending through the inner periphery of the coupling hole 42 and intercommunicating with the coupling hole 42. The locking end 213 of the locking knob 21 is configured to extend into the radial hole 44. As shown in FIG. 6, a sealing portion 45 is disposed on a front end of the inner periphery of the coupling hole 42. The sealing portion 45 has a diameter slightly larger than the diameter of the front section 34 of the tubular member. A rear side of the sealing portion 45 can press against the shoulder 341 of the tubular member and can abut against the seal 343.

The insertion section 32 of the tubular member is inserted into the engaging hole 13 and is secured to the container 1 by the fastening member 324. When the key 322 of the insertion section 32 engages with the positioning groove 14, the locking end 213 of the locking knob 21 engages with the locking hole 333 of the tubular member.

Figure 3:
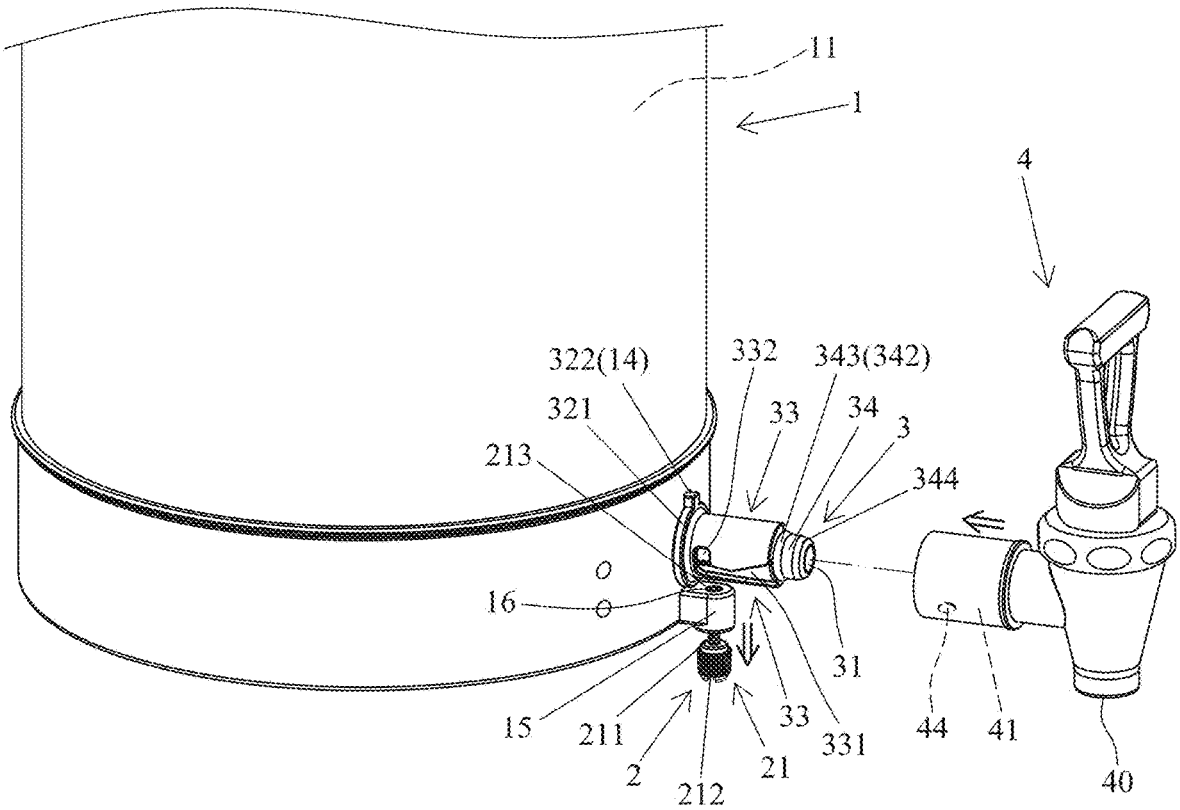
FIG. 3 is an exploded, perspective view illustrating assemblage of the container faucet assembly of FIG. 1.
Figure 4:
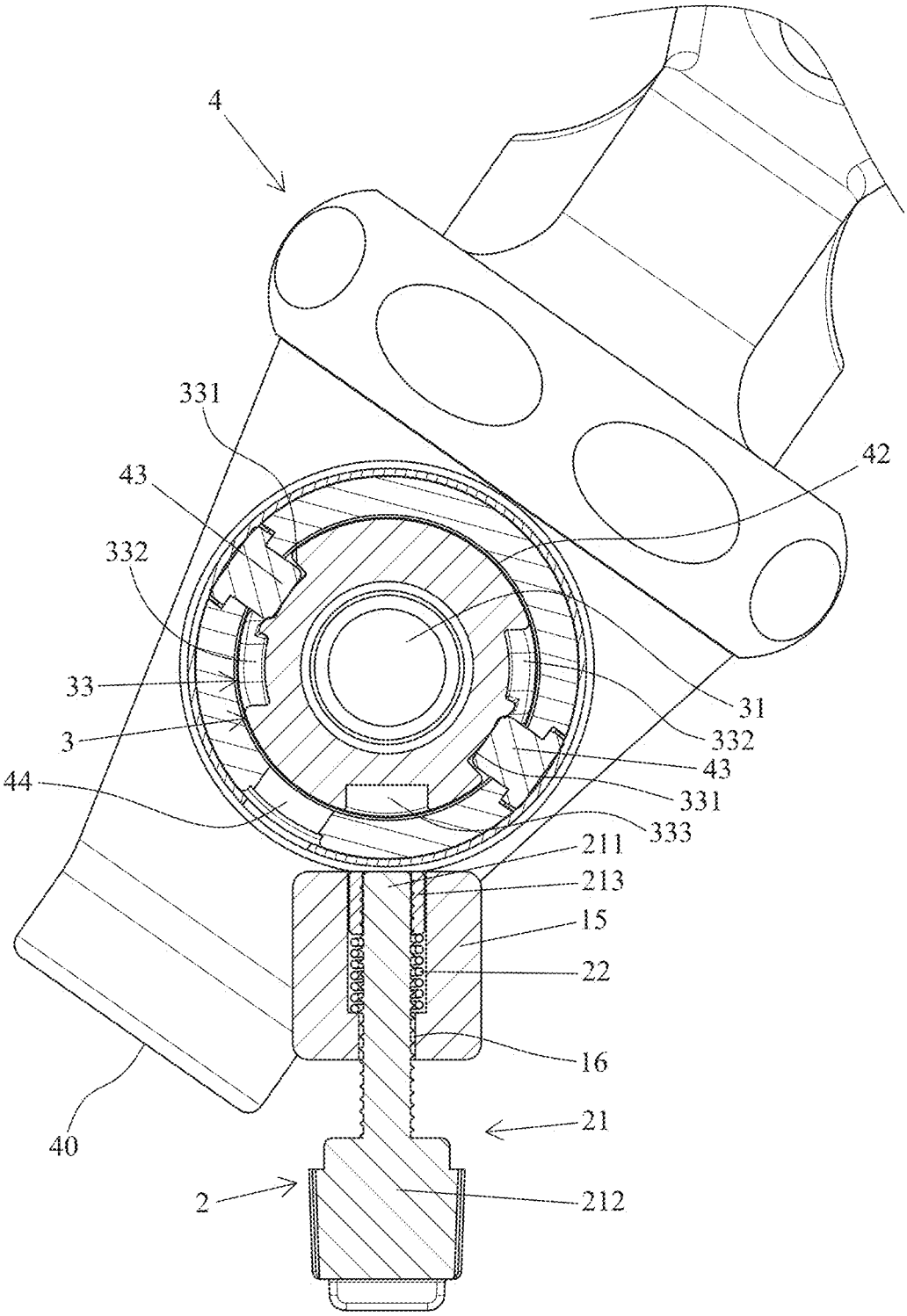
FIG. 4 is a cross sectional view of the container faucet assembly according to the present invention.
Figure 5:
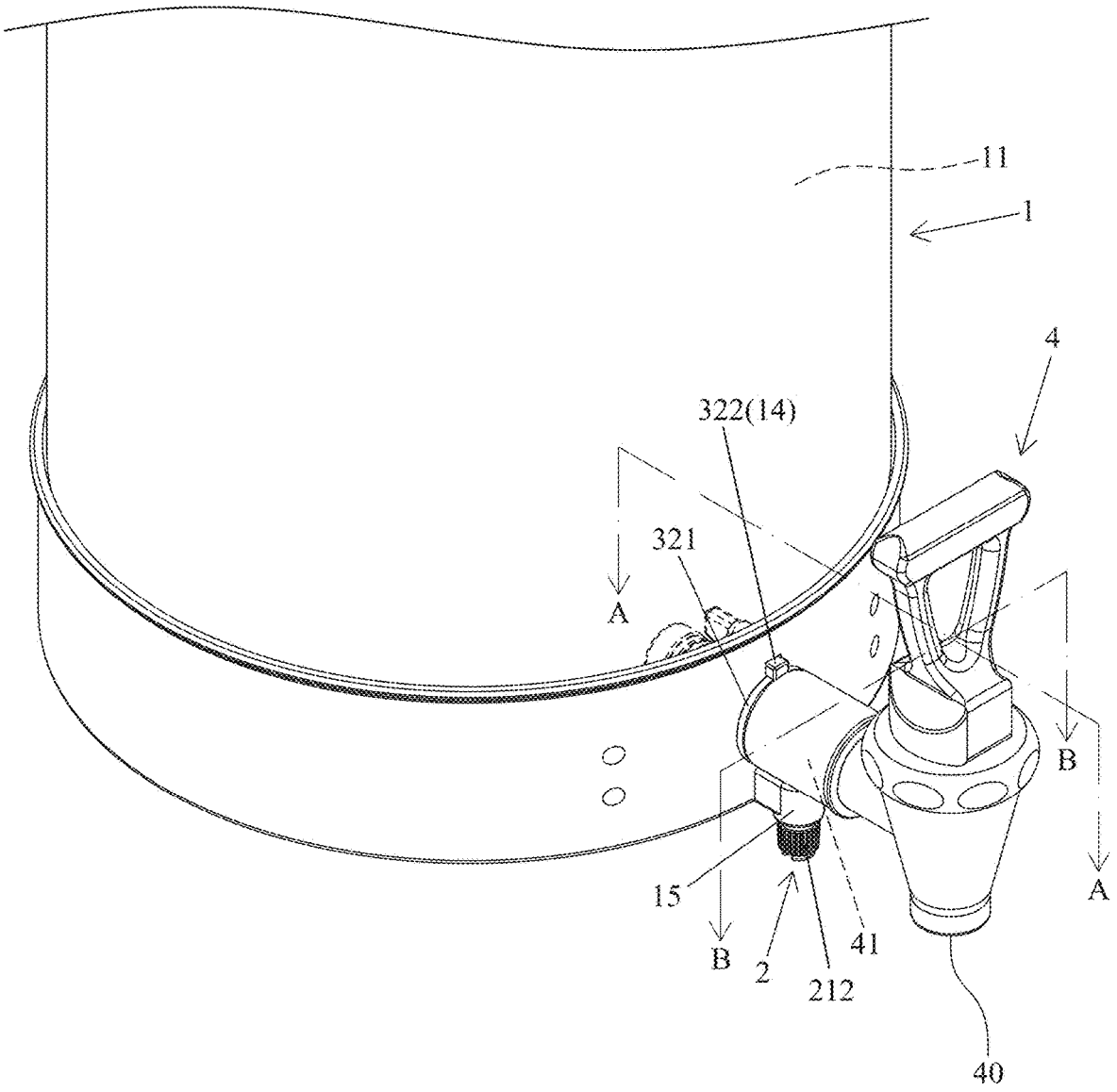
FIG. 5 is a perspective view of the container faucet assembly after assembly.

With reference to FIGS. 3 and 4, in assembly of the faucet 4, the two protrusions 43 of the portion 41 are aligned with the two guiding grooves 331. A user can grip the gripping end 212 of the locking knob 21 to disengage the locking end 213 from the locking hole 333. With reference to FIGS. 4 and 5, the coupling hole 42 of the faucet 4 can be coupled with the tubular member along an extending direction of the tubular member. The conical face 344 of the front section 34 of the tubular member permits easy coupling, because the front end of each of the two guiding grooves 331 is wider than the rear end of the corresponding guiding groove 331. Thus, the two protrusions 43 can move to the rear ends of the two guiding grooves 331.

Figure 7:
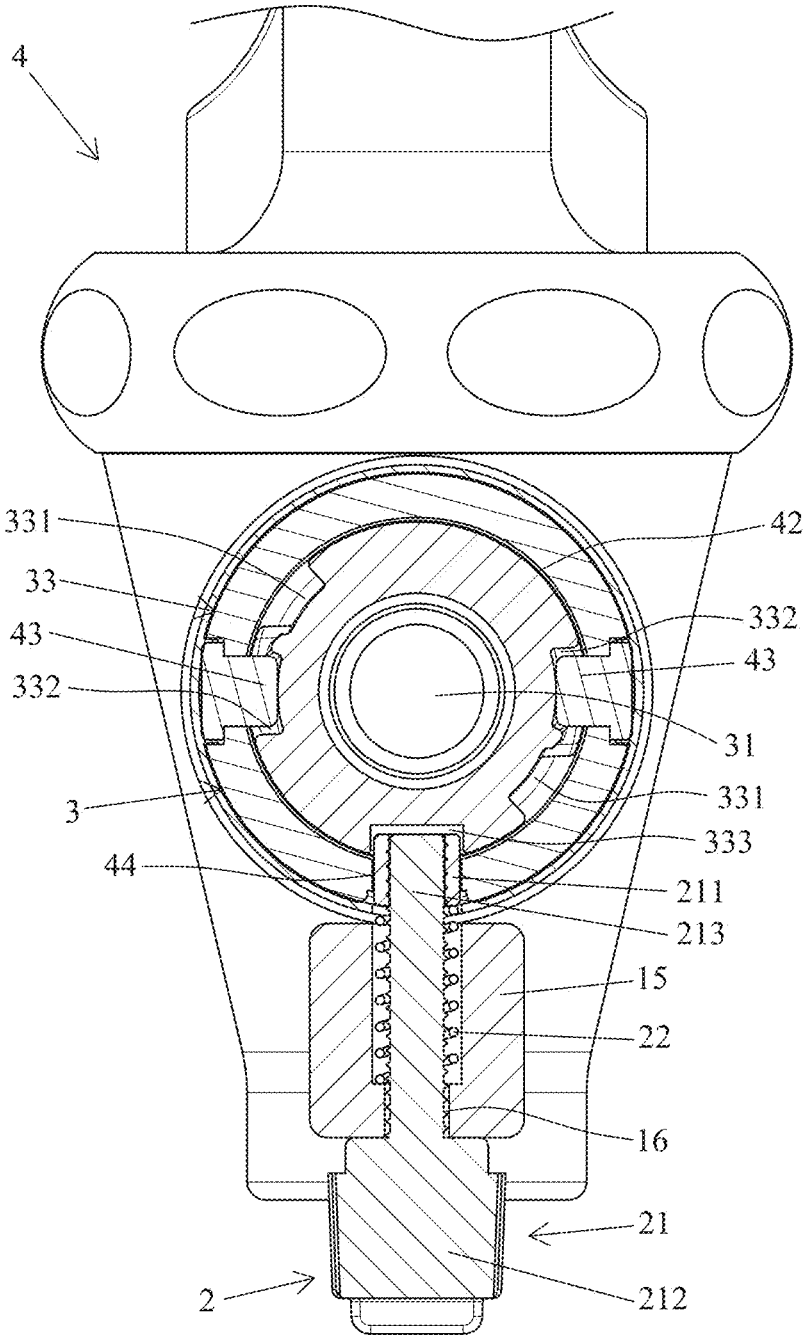
FIG. 7 is a cross sectional view taken along section line B-B of FIG. 5.

With reference to FIGS. 5-7, when the user pivots the faucet 4 to move the two protrusions 43 into the transverse sections 332 of the two guiding grooves 331 without disengaging from the tubular member, the sealing portion 45 tightly presses against the seal 343 at the front section 34. Furthermore, the radial hole 44 is aligned with the locking end 213 of the locking knob 21. When the user releases the gripping end 212 of the locking knob 21, the elastic force of the elastic element 22 urges the locking end 213 of the locking knob 21 to extend through the radial hole 44 of the coupling portion 41 and the locking hole 333 of the coupling section 33.

Figure 8:
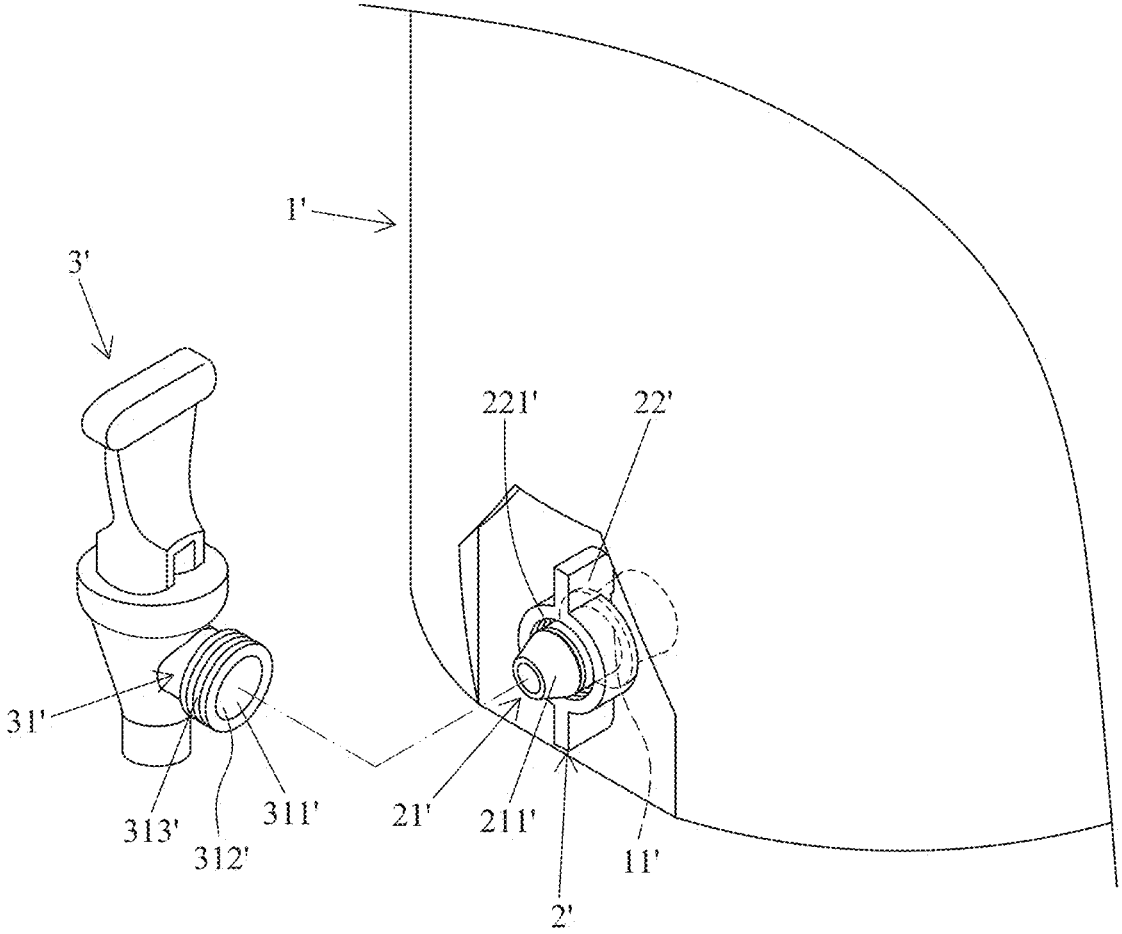
PRIOR ART F I G . 8
FIG. 8 is a diagrammatic exploded, perspective view of a container and a conventional faucet assembly.
Figure 9:
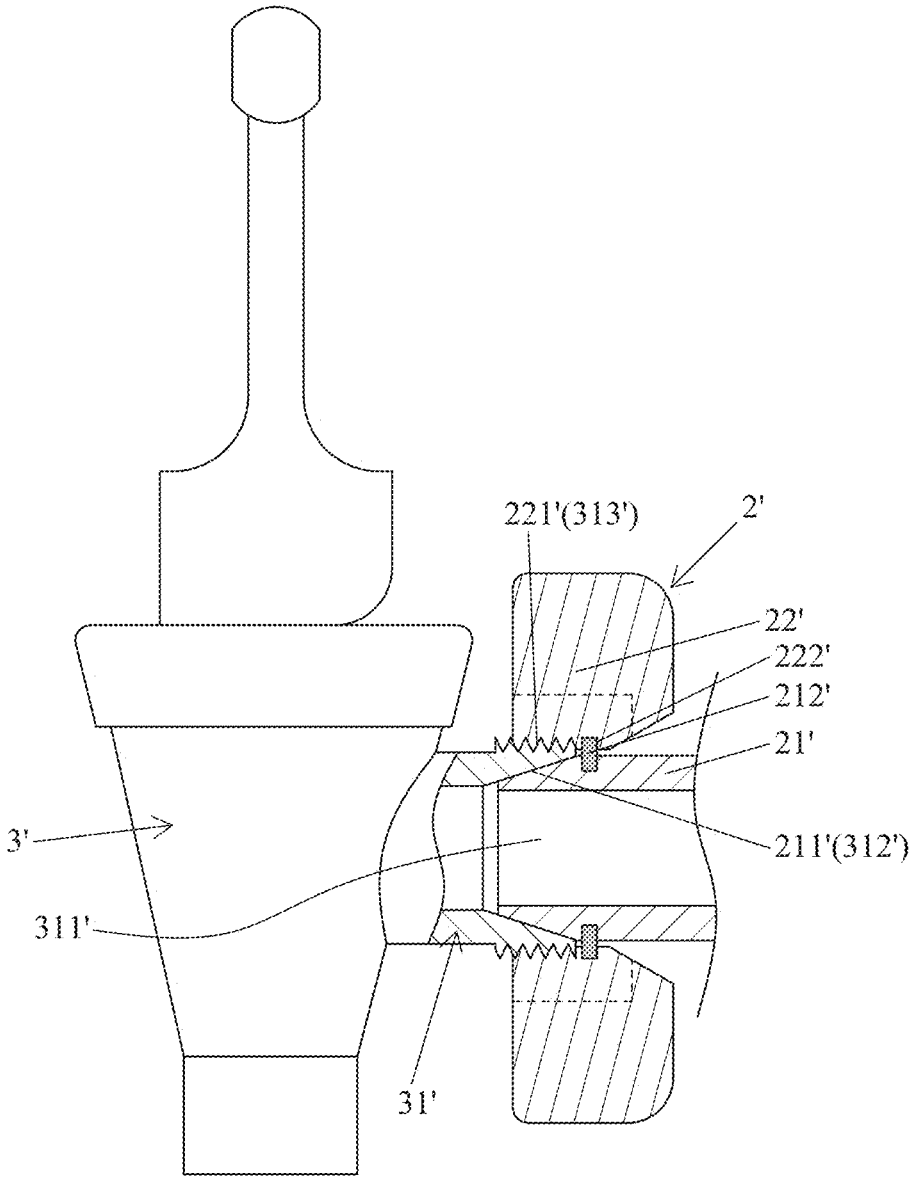
PRIOR ART F I G . 9
FIG. 9 is a diagrammatic cross sectional view of the container and the conventional faucet assembly of FIG. 8.

In view of the foregoing, the troublesome operation in the conventional faucet assembly shown in FIGS. 8 and 9 (including aligning and abutting the first and second conical faces 211' and 312' and tightening the knob 22' with a relatively large force) can be avoided. The container faucet assembly according to the present invention provides improved assembling convenience and a stable sealing effect. When it is desired to clean the faucet 4, the gripping end 212 of the locking knob 21 can be manually pulled to disengage the locking end 213 from the locking hole 333 and the through bore 44 to thereby permit rotation of the faucet 4 in a reverse direction. When the two protrusions 43 of the faucet 4 are at the rear ends of the two guiding grooves 331 shown in FIG. 4, the two protrusions 43 can be moved forwards and can be removed subsequently, permitting easy detachment and easy cleaning.

Thus, the container faucet assembly according to the present invention provides improved convenience in detachment and improved sealing effect.

The faucet 4 can include only one protrusion 43, and the coupling section 33 of the tubular member can include only one guiding groove 331.

Although specific embodiments have been illustrated and described, numerous modifications and variations are still possible without departing from the scope of the invention. The scope of the invention is limited by the accompanying claims.

The invention claimed is:

1. A container faucet assembly comprising:

a container including a compartment and an engaging portion;

a locking device disposed on the engaging portion, wherein the locking device includes a locking knob having a locking end;

a connecting device including a tubular member having a through-hole extending from a front end thereof through a rear end thereof, wherein the tubular member includes, front rear to front, an insertion section, a coupling section, and a front section, wherein the insertion section is coupled with the engaging portion of the container, wherein the coupling section has a rear end connected to the insertion section, wherein the coupling section further includes an outer periphery having at least one guiding groove extending from a front end of the coupling section towards the rear end of the coupling section, wherein the at least one guiding groove includes a transverse section extending transversely from a rear end thereof and at a non-parallel angle to an extending direction of the at least one guiding groove, wherein the coupling section has a locking hole for coupling with the locking end of the locking knob, and wherein a seal is disposed around the front section; and a faucet including an outlet, wherein the faucet further includes a coupling portion on a side thereof, wherein the coupling portion includes a coupling hole intercommunicating with the outlet, wherein the coupling hole includes a rear end having an inner diameter larger than an outer diameter of the coupling section of the tubular member, wherein an inner periphery of the coupling hole includes at least one protrusion slidably received in the at least one guiding groove, wherein the faucet further includes a radial hole extending through the inner periphery of the coupling hole and intercommunicating with the coupling hole, wherein the locking end of the locking knob is configured to extend into the radial hole, and wherein a sealing portion is disposed on the inner periphery of the coupling hole, wherein the at least one protrusion of the faucet is movable along the at least one guiding groove, wherein the faucet is pivotable to move the at least one protrusion of the faucet into the transverse section when the at least one protrusion is aligned with the transverse section, wherein the locking end of the locking knob is insertable into and positionable in the coupling hole of the faucet and the locking hole of the tubular member, and wherein the sealing portion of the faucet is in sealing contact with the seal.

2. The container faucet assembly as claimed in claim 1, wherein the locking device further includes an elastic element providing operating elasticity to the locking knob.

3. The container faucet assembly as claimed in claim 1, wherein the engaging portion of the container includes an engaging hole and a protrusion, wherein the protrusion is disposed adjacent to a peripheral edge of the engaging hole and includes a through bore extending in a direction perpendicular to an extending direction of the engaging hole, wherein an insertion section extends from a side of the locking knob and extends through the through bore of the protrusion of the container, wherein a gripping end is connected to an end of the insertion section and has a diameter larger than the through bore of the protrusion, wherein the locking end is in a form of a locking nut connected to another end of the insertion section, is aligned with the engaging hole of the container, and has a diameter larger than the through bore of the protrusion, wherein the locking device further includes an elastic element in a form of a compression spring having two ends abutting against the protrusion of the container and the locking nut of the locking knob, biasing the locking nut towards the engaging hole.

4. The container faucet assembly as claimed in claim 3, wherein the insertion section of the tubular member includes a rear end extending through the engaging hole of the container, wherein the insertion section includes flange includes a front end abutting the peripheral edge of the engaging hole, wherein the insertion section includes an outer threading, and wherein a fastening member is threadedly mounted around the insertion section and abuts against the peripheral edge of the engaging hole after the insertion section of the tubular member is inserted into the engaging hole of the container, providing a positioning effect.

5. The container faucet assembly as claimed in claim 4, wherein a positioning groove is defined in an inner periphery of the engaging hole, wherein the insertion section includes a key, and wherein when the key engages with the positioning groove, the locking hole is aligned with the locking nut of the locking knob.

6. The container faucet assembly as claimed in claim 1, wherein the at least one guiding groove includes a front end and a rear end, and wherein the front end of the at least one guiding groove has a width larger than a width of the rear end of the at least one guiding groove.

7. The container faucet assembly as claimed in claim 1, wherein the front section of the tubular member has a diameter smaller than a diameter of the coupling section, wherein a shoulder is formed between the front section and the coupling section, wherein an annular groove is disposed in the front section, and wherein the seal is mounted in the annular groove and has an outer diameter larger than the diameter of the front section after the seal is mounted in the annular groove.

8. The container faucet assembly as claimed in claim 7, wherein the sealing portion of the faucet is disposed at a front end of the inner periphery of the coupling hole, has a diameter slightly larger than the diameter of the front section of the tubular member, and abuts against the seal.

9. The container faucet assembly as claimed in claim 1, wherein the front section of the tubular member includes a front end having a conical face, and wherein the conical face has increasing diameters from a front end thereof towards a rear end thereof.

* * * * *